United States Patent [19]

Cisneros

[11] 4,431,185

[45] Feb. 14, 1984

[54] PORTABLE EXERCISE CASE CONTAINING BARBELLS OR THE LIKE

[76] Inventor: Roy R. Cisneros, 1022 27th St., Denver, Colo. 80205

[21] Appl. No.: 320,943

[22] Filed: Nov. 13, 1981

[51] Int. Cl.[3] ..... A63B 21/12

[52] U.S. Cl. ..... 272/117; 220/318; 272/143; 272/DIG. 4; 272/119

[58] Field of Search ..... 272/93, 94, 67, 116, 272/117, 119, 122, 123, 143, DIG. 4, 124; 220/318

[56] References Cited

U.S. PATENT DOCUMENTS

| | | | |
|---|---|---|---|
| 777,478 | 12/1904 | Minor | 272/117 |
| 1,047,212 | 12/1912 | Hamilton | 272/119 |
| 1,316,683 | 9/1919 | Calvert | 272/122 |
| 1,422,888 | 7/1922 | Reeves et al. | 272/122 |
| 1,524,888 | 2/1925 | Schuur | 272/122 |
| 1,530,748 | 3/1925 | Alastalo | 272/94 |
| 1,577,077 | 3/1926 | Ray | 272/67 |
| 3,751,031 | 8/1973 | Yamauchi | 272/119 |

*Primary Examiner*—Richard J. Apley
*Assistant Examiner*—William R. Browne
*Attorney, Agent, or Firm*—Robert C. Dorr

[57] ABSTRACT

A portable exercise case having a weight provided with a hole therethrough, a receptacle for containing the weight, the receptacle having a container having an open section and a lid adapted to be removably attached over the open section of the container, a rod mounted on and extending through the receptacle and on which the weight may be mounted by the rod's extension through the hole provided therein, and at least one handle mounted on the receptacle for aiding a person's lifting of the case.

6 Claims, 9 Drawing Figures

PORTABLE EXERCISE CASE CONTAINING BARBELLS OR THE LIKE

BACKGROUND OF THE INVENTION

There are innumerable devices and machines utilized to exercise the human body. Such devices and machines range from the common and simple, such as a rubber ball which is squeezed to develop the hand and wrist muscles, to complex equipment, such as the well-known NAUTILUS machine which aids in developing a variety of muscles.

The present invention was developed primarily as a result of efforts to combine many of the desirable features of both simple and complex exercise devices and machines into a single, simple exercise device. A patentability search was conducted for the present invention and the followng patents were uncovered:

| Inventor | Patent No. | Issue Date |
|---|---|---|
| C. L. Randall | 596,543 | Jan. 4, 1898 |
| J. Minor | 777,478 | Dec. 13, 1904 |
| R. A. Wood | 1,917,566 | July 11, 1933 |
| J. T. Nist | 2,030,465 | February 11, 1936 |
| A. Shatto | 2,163,107 | June 20, 1939 |
| K. Acs et al | 3,115,338 | Dec. 24, 1963 |
| N. F. Brazier | 3,502,329 | March 24, 1970 |
| Yamauchi | 3,751,031 | Aug. 7, 1973 |
| Boyle | 3,910,577 | Oct. 7, 1975 |
| Schuetz | 4,069,932 | March 21, 1978 |
| Pugh et al | 4,109,908 | August 29, 1978 |
| Hohenfeldt | 4,168,060 | Sept. 18, 1979 |

The 1904 patent issued to Minor illustrates an exercising ball in which a plurality of different weights can be inserted into recesses 2, 3, 4, and 5. Handles 14 are provided for carrying and for exercise purposes.

The 1978 patent issued to Schuetz pertains to an athletic conditioning apparatus which can be selectively filled with water for varying its weight and which is provided with a handle 24 for use in various exercising activities and which has a circular hole 27 that also aids in performing exercises.

The 1898 patent issued to Randall sets forth and indian club in which a plurality of different weights can be inserted for exercise purposes.

The 1936 patent to Nist relates to a receptacle for carrying motion picture films.

The patents issued to Wood, Brazier, Boyle, Yamauchi, and Pugh all relate to different devices which can carry one or more weights, as required, and which attach in some fashion to some part of the body.

A drawback of prior art exercise devices is that each device is capable of being used to develop only a few, and not all of, the basic muscle groups.

SUMMARY OF THE INVENTION

Briefly, in accordance with the present invention, a portable exercise case comprises at least one relatively heavy weight provided with a hole therethrough and a generally hollow receptacle for carrying and containing the weight. The receptacle comprises a container portion having a generally open section and a lid adapted to be removably attached to the container portion and positioned over the container portion open section. A rod is mounted within the receptacle and is sized so as to permit the rod to extend through the hole provided in each weight. Thus, weights may be mounted on the rod and enclosed in the receptacle by attachment of the lid to the container portion of the receptacle. A handle is mounted on the outside of the receptacle for aiding a person's transporting of and lifting of the exercise case. Furthermore, the case may be provided with straps and clasps or hooks for connecting the straps to the receptacle, thereby providing a harness with which to secure the case to a person's body.

Because different numbers and sizes of weights may be mounted on the rod enclosed in the receptacle, the case is capable of providing different degrees of muscle strain. Moreover, sundry exercises may be performed with the case for the development of different muscles. It can also be appreciated that the case is relatively small in size and portable. Furthermore, case is of a sturdy construction and a simple design, thereby making the case easy and inexpensive to manufacture.

Additional advantages and features of the present invention will become apparent after reading the following description of the preferred embodiment in conjunction with the accompanying drawings.

BRIEF DESCRIPTION OF THE DRAWINGS

The invention will be described with reference to the accompanying drawings wherein.

DESCRIPTION OF A PREFERRED EMBODIMENT

Figures 1, 2, 3, 4, 5, 6, 7, 8, 9:
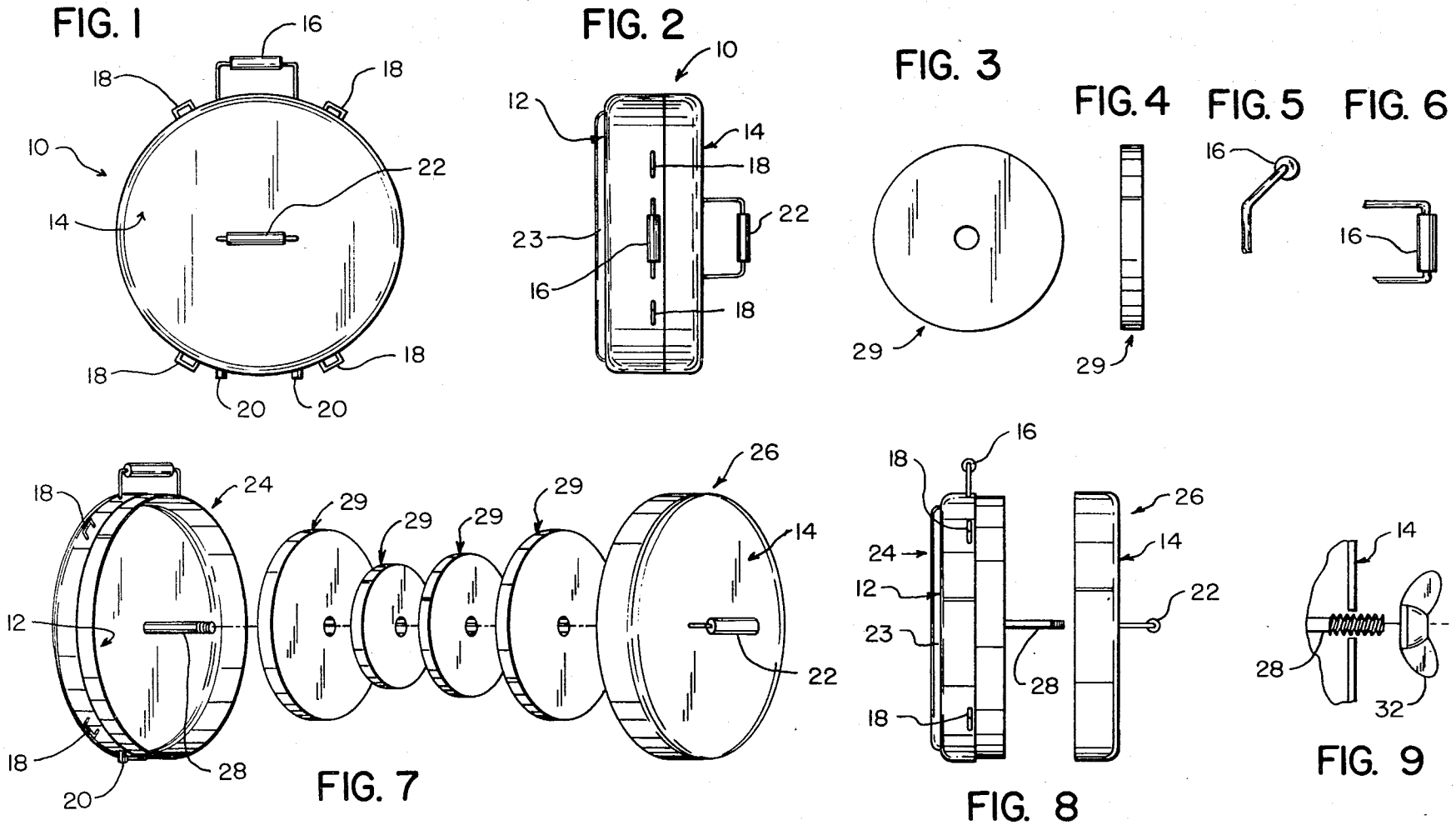
FIG. 1 is a front view of a portable exercise case according to an embodiment of the present invention.
FIG. 2 is a top view of the portable exercise case shown in FIG. 1.
FIG. 3 is a front view of a weight which may be utilized in the portable exercise case shown in FIG. 1.
FIG. 4 is a side view of the weight shown in FIG. 3.
FIG. 5 is a side view of a handle that may be utilized in the portable exercise case shown in FIG. 1.
FIG. 6 is a top view of the handle shown in FIG. 5.
FIG. 7 is an exploded, perspective view of the portable exercise case shown in FIG. 1.
FIG. 8 is a partially exploded side view of the portable exercise case shown in FIG. 1.
FIG. 9 shows the threaded end of a rod extending through a hole provided in the lid element of the portable exercise case shown in FIG. 1 along with a wing nut for threadably attaching to the protruding, threaded end of the rod.

Referring now to the drawings wherein like reference numerals and symbols refer to the same item, there is shown in FIGS. 1 and 2 a portable exercise case constructed according to an embodiment of the present invention. The case includes a generally hollow, cylindrically shaped receptacle 10 for carrying and containing weights. As shown in FIG. 1, an end view of the receptacle 10 depicts the receptacle 10 as being circular, however, it should be understood that the end view of the receptacle 10 could be a variety of shapes including such shapes as a hexagon or a square. In these latter two types of shapes, the receptacle 10 could be angular at the intersection of the planar sides or could be rounded at such intersections. As shown most clearly in FIG. 2, the receptacle 10 is provided with two planar, parallel end walls 12, 14. Again, it should be understood that these end walls 12, 14 need not be of the particular shape shown in FIG. 2. As shown in FIGS. 2 and 8, the regions of the receptacle 10 where the end walls 12, 14 join the peripheral section of the receptacle 10 are rounded, thereby eliminating any angular corners which might cause discomfort to a user of the case if the case were to bump or rub against the user.

A handle 16 is mounted on the top peripheral surface of the receptacle 10. The handle 16 serves as an aid in carrying and lifting the exercise case. As shown in FIGS. 5 and 6, the handle 16 may be bent or curved so that lifting of the case by the handle 16 for performing various exercises is not limited because of interference between the user's hand and the portion of the handle attaching the same to the receptacle 10. Mounted about the periphery of the receptacle 10 are four angularly spaced clasps, hooks or the like 18 which are preferably swivelably attached to the receptacle 10. By means of the clasps or hooks 18, a strap or straps 19 may be secured to and swivelable with respect to the receptacle 10. The strap functions as a harness by which the exercise case may be attached at various locations to a person's body. Four feet 20 are mounted on the bottom peripheral surface of the receptacle 10 for providing a stable base through which the exercise case may contact and rest upon a supporting surface such as a floor. The number of feet utilized may of course vary, and the feet may comprise two elongated parallel ribs. A second handle 22 is removably mounted (by means not shown) at the center of one end wall 14 of the receptacle 10. It is contemplated that such second handle 22 may be removably mounted on the receptacle 10 at a variety of locations.

As shown in FIGS. 2 and 8 a padding 23 comprised of soft plastic, foam rubber or the like may cover a substantial portion of the outer surface of the end wall 12 of the receptacle 10. The padding 23 is designed to cushion contact between the case and its user, such as when the case is placed on the user's back (perhaps by harnessing the same to the user). Also such padding 23 functions as insulation between the case and its user, such as when the receptacle 10 is formed of metal and feels relatively cold against the skin of the user. Such padding 23 may be placed on the receptacle outer surface at various locations.

As shown in FIGS. 7 and 8, the receptacle 10 is composed of two sections, a container portion 24 and a closure or lid 26. The container portion 24 is generally hollow and generally cylindrically shaped and open at its axial end opposite to the end wall 12. The lid 26 is generally hollow and generally cylindrically shaped and open at its axial end opposite to the end wall 14. As shown in FIG. 8, the rim of the container portion 24 is recessed so that the rim of the lid 26 may overlap the same and so the outer surfaces of the container portion 24 and the lid 26 are flush with each other. Alternatively, the rim of the container portion 24 need not be recessed and the lid 26 could overlap the same, however, in this embodiment, the container portion 24 and the lid 26 would not be flush with each other. The lid 26 may be removably attached to the container portion 24 by means of buckles, drawpull catches or the like (not shown).

A rod 28 is centrally mounted on the end wall 12 of the container portion 24 and extends axially toward the open axial end thereof. The rod 28 may be mounted on the container portion 24 by a variety of means. For example, if the receptacle 10 is fashioned of hard plastic, the rod 28 may also be fashioned of hard plastic and formed integrally with the receptacle 10, whereas if the receptacle 10 is formed of steel, the rod 28 may also be formed of steel and might be welded to the container portion 24. The length of the rod 28 in one embodiment of present invention is chosen such that the free rod end is only slightly spaced from the end wall 14 of the lid 26 when the lid 26 is attached to the container portion 24. The rod 28 is of a sufficient length and of a sufficient width or diameter to receive at least one relatively heavy object or weight having a hole therethrough. Such relatively heavy objects may comprise so-called barbells, which are circular plates provided with a hole centrally therethrough and which are sometimes covered with resilient plastic. Such barbells 29 are shown in FIGS. 3, 4 and 7. The barbells 29 may differ in mass, the difference may be caused by different barbell thicknesses or diameters.

As shown in FIG. 7 the barbells 29 may be mounted on the rod 28 by extending the rod 28 through the holes provided in the barbells. Depending upon the length of the rod 28 and the thicknesses of the barbells 29, any selected number and weights of barbells may be mounted on the rod 28, whereby the exercise case itself may be selectively weighted. Typically, the receptacle 10 may have an axial length of between five to fifteen centimeters for accommodating and containing two to four standard width barbells. Because the forces on the rod 28 during use of the exercise case are strong and tend to disattach the rod 28 from the carrier portion 24, the inner surface of the end wall 14 of the lid 26 may be provided with a depression or dimple for receiving the free end of the rod 28. With such a construction, the forces applied to the rod 28 would be transmitted to both end walls 12, 14 of the receptacle 10.

The rod 28 may also be adapted for use in removably attaching the lid 26 to the container portion 24. As shown in FIG. 9, the end wall 14 of the lid 26 is provided with a hole centrally therethrough which is of approximately the same diameter as the rod 28. The length of the rod 28 is selected such that the free end of the rod 28 protrudes a short distance through the hole in the end wall 14 when the container portion 24 and the lid 26 are positioned for attachment. The protruding end of the rod 28 is threaded, and a wing nut 32 or the like may be threadably secured to the threaded, protruding rod end to secure and attach the lid 26 to the container portion 24.

The exercise case of the present invention is small in size, compact and portable. Moreover, the exercise case has a simple design, is of a sturdy construction, and is easy and inexpensive to manufacture. The exercise case can have virtually any selected weight, and the weight thereof may be quickly, easily and readily changed to accommodate the needs of different users or to accommodate the needs for different exercises performed by the same user. Because the handles of the exercise case may be mounted in a variety of locations and because the exercise case is adapted for use with harness straps, the exercise block can be grasped by or harnessed to a user in a wide variety of manners for the exercise of and development of a wide variety of different muscles.

From the foregoing, one can readily appreciate that the exercise case of the present invention is ideally suited for use on trips, when it is difficult to find and utilize a gym having exercise equipment and when it is cumbersome or embarrassing to carry exercise equipment such as dumbbells or a bar and a plurality of barbells.

Some of the exercises that may be performed with the exercise case of the present invention will now be described. For developing the biceps, one may grasp the top handle 16 with one hand and perform so-called "curls" with the forearm, wrist and hand. For developing the triceps, one may grasp the top handle 16 with both hands extended behind the head and then vertically displace the case. For developing the shoulder muscles, one may grasp the top handle 16 with one hand above the shoulder and then vertically displace the case or one may grasp the top handle 16 with both hands in front of the waist and then vertically displace the case. In this latter instance, both the shoulder muscles and the trapezius muscles are developed. For developing the back, deltoid, shoulder, and so-called "lat" muscles, one may rest the case upon an end wall such that the second handle, positioned as shown in FIG. 1 is pointing upwardly, then one may stand over the case, bend over at the waist, grasp the second handle with both hands, and then vertically displace the case. For developing the pectoral muscles, one may strap the case on the back and then perform "push-ups". For developing the thigh and calf muscles, one may strap the case on the back and then perform "squats" and "toe-raises", respectively.

From the foregoing it can be appreciated that the portable exercise case, unlike prior exercise devices, can be used not only to develop a wide variety of muscles, but also to develop all of the basic muscle groups.

It is preferred that the axial length of the case be relatively small compared with the diameter of the case, so that exercises such as those described above may be performed without the case itself interfering with the performance of such exercises.

Although particular embodiments of the present invention have been described and illustrated herein, it should be recognized that modifications and variations may readily occur to those skilled in the art and that such modifications and variations may be made without departing from the spirit and scope of my invention. Consequently, my invention as claimed below may be practiced otherwise than is specifically described above.

I claim:

1. A portable exercise case comprising:

(a) at least one relatively heavy weight provided with a hole therethrough;

(b) a generally hollow receptacle for carrying and containing said weight and comprising a container portion having a generally open section and a closure or lid normally disposed over the container portion open section and adapted to be removably attached to said container portion;

(c) means for removably attaching said lid to said container portion;

(d) a rod mounted within and extending through said receptacle, said rod having a diameter or thickness sufficiently small to permit said rod to extend through the hole provided in said weight such that the weight may be mounted on said rod and may be carried and contained in said receptacle;

(e) a handle mounted on the outside of said receptacle for aiding a person's transporting of and lifting of the case;

(f) at least one substantially flat surface means for engaging the body of a person exercising with the case.

2. The portable exercise case according to claim 1 wherein said lid is provided with a hole therethrough, the hole being sufficiently wide to permit said rod to extend therethrough, wherein said rod is sufficiently long and so mounted within said receptacle that an end thereof protrudes through the hole provided in said lid when said lid is positioned over the container portion open section, wherein the rod end protruding through the hole provided in said lid is threaded, and wherein said means for removably attaching said lid to said container portion includes a nut adapted to be removably, threadably secured to the threaded rod end.

3. The portable exercise case according to claim 1 further comprising a second handle adapted to be removably attached to said lid and means for removably attaching said second handle to said lid.

4. The portable exercise case according to claim 1 further comprising a plurality of feet mounted on the outside of said receptacle for providing a stable base through which the case may contact and rest upon a supporting surface.

5. The portable exercise case according to claim 1 further comprising at least one resilient, deformable pad mounted on the exterior surface of said receptacle.

6. An exercise device comprising (a) at least one relatively heavy, substantially cylindrical weight provided with a hole substantially axially therethrough;

(b) a generally hollow, generally cylindrical receptacle for carrying and containing said weight and comprising a container portion having a generally open axial end and a closure or lid provided with a hole therethrough and normally disposed over the container portion open end and adapted to be removably attached to said container portion;

(c) a rod mounted within and extending substantially axially through said receptacle, said rod having a diameter or thickness sufficiently small to permit said rod to extend through the hole provided in said weight and through the hole provided to said lid, said rod being sufficiently long and so mounted within said receptacle that an end thereof protrudes through the hole provided in said lid when said lid is disposed over the container portion open end, the region of said rod protruding through the hole provided in said lid being threaded;

(d) a nut adapted to be removably, threadably secured to the threaded rod end;

(e) a handle secured to and mounted on the outside surface of said receptacle other than the axial ends thereof;

(f) a second handle adapted to be attached to an axial end of said receptacle;

(g) a plurality of feet mounted on the outside surface of said receptacle for providing a stable base through which the device may contact and rest upon a supporting surface; and (h) at least one resilient, deformable pad mounted on the outside surface of said receptacle.

* * * * *

UNITED STATES PATENT AND TRADEMARK OFFICE

CERTIFICATE OF CORRECTION

PATENT NO. : 4,431,185

DATED : February 14, 1984

INVENTOR(S) : Roy R. Cisneros

It is certified that error appears in the above-identified patent and that said Letters Patent is hereby corrected as shown below:

In the drawings, Sheet 1, Figure 1, reference numeral 19 should appear and be applied to straps which should be attached to clasps or hooks 18 as follows:

FIG. 1

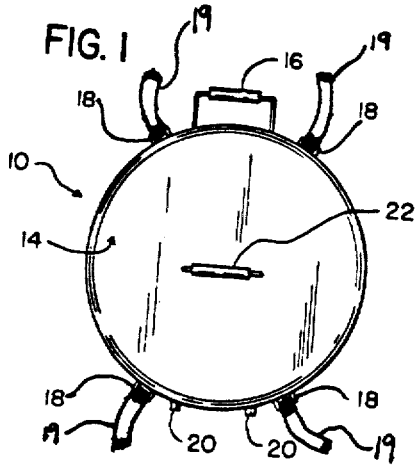

Signed and Sealed this

Twenty-ninth Day of January 1985

[SEAL]

*Attest:*

DONALD J. QUIGG

*Attesting Officer* *Acting Commissioner of Patents and Trademarks*